US012075873B2

(12) United States Patent
Hau et al.

(10) Patent No.: US 12,075,873 B2
(45) Date of Patent: Sep. 3, 2024

(54) ILUMINATION ASSEMBLY FOR A HAT

(71) Applicant: Carhartt, Inc., Dearborn, MI (US)

(72) Inventors: Colleen Hau, Birmingham, MI (US); Jonathan West, Ferndale, MI (US); Saif Islam, Oak Park, MI (US); Sean Svendsen, Columbus, OH (US)

(73) Assignee: Carhartt, Inc., Dearborn, MI (US)

( * ) Notice: Subject to any disclaimer, the term of this patent is extended or adjusted under 35 U.S.C. 154(b) by 0 days.

(21) Appl. No.: 18/099,617

(22) Filed: Jan. 20, 2023

(65) Prior Publication Data

US 2023/0232928 A1 Jul. 27, 2023

Related U.S. Application Data

(60) Provisional application No. 63/301,700, filed on Jan. 21, 2022.

(51) Int. Cl.
*A42B 1/242* (2021.01)

(52) U.S. Cl.
CPC ..... *A42B 1/242* (2013.01)

(58) Field of Classification Search
CPC ..... A42B 1/242
See application file for complete search history.

(56) References Cited

U.S. PATENT DOCUMENTS

| | | | |
|---|---|---|---|
| 1,586,701 | A | 6/1926 | Reppa |
| 1,689,090 | A | 10/1928 | Watkins |
| 1,744,777 | A | 1/1930 | Lundgren |
| 2,399,030 | A | 9/1943 | Hostetler |
| 2,640,980 | A | 6/1953 | Nathan |
| 2,926,356 | A | 3/1960 | Taylor |
| 3,032,647 | A | 5/1962 | Wansky et al. |
| 4,156,942 | A | 6/1979 | Isfeld |
| 4,406,040 | A | 9/1983 | Cannone |
| 4,667,274 | A | 5/1987 | Daniel |
| 4,827,384 | A | 5/1989 | Von Schlemmer |
| 4,991,068 | A | 2/1991 | Mickey |
| 5,111,366 | A | 5/1992 | Rife et al. |
| 5,363,291 | A | 11/1994 | Steiner |
| 5,404,593 | A | 4/1995 | Kronenberger |
| 5,479,325 | A | 12/1995 | Chien |

(Continued)

FOREIGN PATENT DOCUMENTS

| | | | |
|---|---|---|---|
| AU | 2006241385 | A1 | 12/2006 |
| AU | 2008338320 | A1 | 6/2009 |

(Continued)

OTHER PUBLICATIONS

International Search Report and Written Opinion of the International Search Authority from the International Searching Authority for related International Application No. PCT/US2023/011245 dated Apr. 25, 2023, 9 pages.

*Primary Examiner* — Thomas M Sember
(74) *Attorney, Agent, or Firm* — Dickinson Wright PLLC

(57) ABSTRACT

An illuminated hat assembly including a mounting bracket for being secured to a hat. A light assembly is removably connectable to the mounting bracket and includes at least one light emitter for emitting light in front of the hat. The mounting bracket includes a pair of rails that extend in spaced and parallel relationship with one another. The rails slideably receive the light assembly for connecting the light assembly to the mounting bracket.

18 Claims, 8 Drawing Sheets

(56) References Cited

U.S. PATENT DOCUMENTS

| | | | | |
|---|---|---|---|---|
| 5,485,358 | A | 1/1996 | Chien | |
| 5,510,961 | A | 4/1996 | Peng | |
| 5,541,816 | A | 7/1996 | Miserendino | |
| 5,567,038 | A | 10/1996 | Lary | |
| 5,667,292 | A | 9/1997 | Sabalvaro, Jr. | |
| 5,676,449 | A | 10/1997 | Newsome | |
| 5,680,718 | A | 10/1997 | Ratcliffe et al. | |
| 5,738,432 | A | 4/1998 | Okko et al. | |
| 5,741,060 | A | 4/1998 | Johnson | |
| 5,845,987 | A | 12/1998 | Painter | |
| D407,187 | S | 3/1999 | Makki | |
| 6,007,211 | A | 12/1999 | Cheung | |
| 6,056,413 | A | 5/2000 | Urso | |
| 6,116,745 | A | 9/2000 | Yei | |
| 6,168,286 | B1 | 1/2001 | Duffy | |
| 6,206,543 | B1 | 3/2001 | Henry | |
| D441,518 | S | 5/2001 | Bean | |
| 6,256,795 | B1 | 7/2001 | Habel | |
| 6,328,454 | B1 | 12/2001 | Davis | |
| 6,457,838 | B1 * | 10/2002 | Dugmore | F21V 21/084 362/108 |
| 6,604,837 | B2 | 8/2003 | Sandberg | |
| 6,659,618 | B2 | 12/2003 | Waters | |
| 6,752,511 | B1 | 6/2004 | Cramer | |
| 6,863,416 | B2 | 3/2005 | Waters | |
| 6,895,602 | B2 | 5/2005 | Schlapkohl | |
| 6,923,551 | B2 | 8/2005 | Galli | |
| 6,932,487 | B2 | 8/2005 | Aknine | |
| 6,941,583 | B2 | 9/2005 | Yan | |
| 7,000,841 | B2 | 2/2006 | Becker | |
| 7,055,979 | B2 | 6/2006 | Lee | |
| 7,104,670 | B2 | 9/2006 | Waters | |
| 7,118,241 | B2 | 10/2006 | Sohn | |
| 7,131,745 | B2 | 11/2006 | Sibbett | |
| 7,163,309 | B2 | 1/2007 | Sohn | |
| 7,240,883 | B2 * | 7/2007 | Liao | F21L 4/00 248/278.1 |
| 7,427,149 | B2 | 9/2008 | Sohn | |
| 7,431,472 | B2 | 10/2008 | Becker | |
| 7,506,992 | B2 | 3/2009 | Carter | |
| 7,524,081 | B2 | 4/2009 | Dalton et al. | |
| 7,611,255 | B1 | 11/2009 | Lagassey | |
| 7,661,818 | B2 | 2/2010 | Waters | |
| 7,699,485 | B1 | 4/2010 | Lagassey | |
| 7,708,422 | B2 | 5/2010 | Sohn | |
| 7,753,547 | B2 | 7/2010 | Waters | |
| RE41,795 | E | 10/2010 | Dalton et al. | |
| 7,810,944 | B2 | 10/2010 | Liao | |
| 7,850,331 | B2 | 12/2010 | Dalton et al. | |
| 7,874,693 | B2 | 1/2011 | Liao | |
| 8,002,437 | B2 | 8/2011 | Sohn | |
| 8,333,485 | B2 | 12/2012 | Waters | |
| 8,388,164 | B2 | 3/2013 | Waters | |
| 8,444,285 | B2 | 5/2013 | Lau | |
| 8,491,145 | B2 | 7/2013 | Waters | |
| 8,550,651 | B2 | 10/2013 | Waters | |
| 8,721,104 | B2 | 5/2014 | Liao | |
| 8,757,831 | B2 | 6/2014 | Waters | |
| 8,783,892 | B2 | 7/2014 | Liao | |
| 9,101,174 | B2 | 8/2015 | Waters | |
| 9,185,278 | B2 | 11/2015 | Waters | |
| 9,526,287 | B2 | 12/2016 | Waters | |
| 9,568,173 | B2 | 2/2017 | Waters | |
| 9,585,431 | B2 | 3/2017 | Waters | |
| 9,872,531 | B2 * | 1/2018 | Uke | A42B 3/04 |
| 10,159,294 | B2 | 12/2018 | Waters | |
| D871,726 | S | 1/2020 | Schweiger | |
| D872,425 | S | 1/2020 | Schweiger | |
| 10,716,350 | B2 | 7/2020 | Waters | |
| 10,731,835 | B2 | 8/2020 | Ross | |
| 10,782,006 | B1 | 9/2020 | Ross | |
| 10,791,783 | B1 | 10/2020 | Waters | |
| 10,907,811 | B2 | 2/2021 | Ross | |
| 2001/0024365 | A1 | 9/2001 | Aknine | |
| 2003/0026093 | A1 | 2/2003 | Sandberg | |
| 2004/0145888 | A1 | 7/2004 | Sohn | |
| 2004/0228119 | A1 | 11/2004 | Becker | |
| 2005/0047117 | A1 | 3/2005 | Scholl et al. | |
| 2005/0207143 | A1 | 9/2005 | Bishop et al. | |
| 2006/0157569 | A1 | 7/2006 | Becker | |
| 2006/0198122 | A1 | 9/2006 | Senter et al. | |
| 2008/0080172 | A1 | 4/2008 | Mayo et al. | |
| 2008/0212311 | A1 | 9/2008 | Peterson | |
| 2009/0135589 | A1 | 5/2009 | Dalton et al. | |
| 2010/0142191 | A1 | 6/2010 | Liao | |
| 2010/0142192 | A1 | 6/2010 | Liao | |
| 2010/0214767 | A1 | 8/2010 | Waters | |
| 2010/0289433 | A1 | 11/2010 | Lau | |
| 2010/0301779 | A1 * | 12/2010 | Spartano | H05B 45/345 362/184 |
| 2010/0313335 | A1 | 12/2010 | Waters | |
| 2011/0075405 | A1 | 3/2011 | Dalton et al. | |
| 2011/0122601 | A1 | 5/2011 | Waters | |
| 2011/0157874 | A1 | 6/2011 | Sant et al. | |
| 2011/0210685 | A1 | 9/2011 | Liao | |
| 2013/0033852 | A1 | 2/2013 | Liao | |
| 2013/0111651 | A1 | 5/2013 | Waters | |
| 2013/0192961 | A1 | 8/2013 | Waters | |
| 2013/0198935 | A1 | 8/2013 | Waters | |
| 2013/0201299 | A1 | 8/2013 | Waters | |
| 2013/0242544 | A1 | 9/2013 | Liao | |
| 2014/0049947 | A1 | 2/2014 | Lombard et al. | |
| 2014/0085871 | A1 | 3/2014 | Tsao | |
| 2014/0173807 | A1 | 6/2014 | Waters | |
| 2014/0218962 | A1 | 8/2014 | Waters | |
| 2014/0268683 | A1 | 9/2014 | Waters | |
| 2014/0268684 | A1 | 9/2014 | Waters | |
| 2014/0304891 | A1 | 10/2014 | Waters | |
| 2015/0250245 | A1 | 9/2015 | Waters | |
| 2019/0231016 | A1 | 8/2019 | Deshpande et al. | |
| 2020/0037685 | A1 | 2/2020 | Graham | |
| 2020/0318818 | A1 | 10/2020 | Ross | |
| 2020/0355353 | A1 | 11/2020 | Kaye et al. | |
| 2020/0378585 | A1 | 12/2020 | Ross | |

FOREIGN PATENT DOCUMENTS

| | | | |
|---|---|---|---|
| AU | 2006241385 | B2 | 10/2009 |
| AU | 2011101143 | A4 | 10/2011 |
| AU | 2011101143 | B4 | 10/2011 |
| AU | 2014227728 | A1 | 9/2015 |
| BR | PI0819557 | A2 | 5/2015 |
| CA | 2355344 | A1 | 3/2001 |
| CA | 2608746 | A1 | 11/2006 |
| CA | 2709991 | A1 | 6/2009 |
| CA | 2753717 | A1 | 9/2010 |
| CA | 2797971 | A1 | 11/2011 |
| CA | 2797973 | A1 | 11/2011 |
| CA | 2794370 | A1 | 5/2013 |
| CA | 2905067 | A1 | 9/2014 |
| CN | 203384917 | U | 1/2014 |
| DE | 19612618 | A1 | 10/1997 |
| DE | 19612618 | C2 | 6/2000 |
| DE | 212010000023 | U1 | 1/2012 |
| EP | 1072204 | A2 | 1/2001 |
| EP | 1072204 | A3 | 7/2002 |
| EP | 1639294 | B8 | 10/2012 |
| EP | 2238386 | B1 | 4/2014 |
| ES | 1077908 | U | 10/2012 |
| ES | 2478679 | T3 | 7/2014 |
| ES | 2586621 | T3 | 10/2016 |
| FR | 1221782 | A | 6/1960 |
| FR | 2798720 | A1 | 3/2001 |
| KR | 20190000693 | U | 3/2019 |
| KR | 20190042874 | A | 4/2019 |
| KR | 102121312 | B1 | 6/2020 |
| MX | 2012012645 | A | 2/2013 |
| MX | 2012012646 | A | 3/2013 |
| WO | 9504896 | A1 | 2/1995 |
| WO | 0121021 | A1 | 3/2001 |
| WO | 2006037845 | A1 | 4/2006 |
| WO | 2006096595 | A2 | 9/2006 |
| WO | 2007093132 | A1 | 8/2007 |
| WO | 2009079656 | A2 | 6/2009 |

(56) References Cited

FOREIGN PATENT DOCUMENTS

| | | | |
|---|---|---|---|
| WO | 2010099504 | A1 | 9/2010 |
| WO | 2011137400 | A1 | 11/2011 |
| WO | 2011137406 | A2 | 11/2011 |
| WO | 2013096895 | A1 | 6/2013 |
| WO | 2013096904 | A1 | 6/2013 |
| WO | 2014100477 | A1 | 6/2014 |
| WO | 2014144276 | A2 | 9/2014 |
| WO | 2014144276 | A3 | 9/2014 |

* cited by examiner

| Level | 1 | 2 | 3 | 4 | 5 |
|---|---|---|---|---|---|
| Total Power (mWatt) | 650 | 450 | 300 | 200 | 120 |
| Total Power (Watt) | 0.65 | 0.45 | 0.3 | 0.2 | 0.12 |

ILUMINATION ASSEMBLY FOR A HAT

CROSS-REFERENCE TO RELATED APPLICATIONS

This application claims the benefit and priority to U.S. Provisional Patent Application Ser. No. 63/301,700, filed on Jan. 21, 2022, the entire disclosure of which is incorporated herein by reference.

FIELD OF THE DISCLOSURE

The present disclosure relates to an illumination assembly. More particularly, the present disclosure relates to an illumination assembly including a mounting bracket for being secured to a hat, and a light assembly that is removeably connectable to the mounting bracket such that the light assembly can easily be connected to, and removed from the hat.

BACKGROUND OF THE DISCLOSURE

This section provides background information related to the present disclosure which is not necessarily prior art.

Illuminated hat assemblies are known in the art for providing hands-free illumination of a region in front of a user. For example, U.S. Pat. No. 4,406,040 to Cannone discloses an illuminated hat assembly that includes a mounting bracket for being clipped to a brim of a hat. A light assembly is connectable to the mounting bracket via a pin and slot connection mechanism. The illuminated hat assembly is complicated and bulky, and the entire assembly must be removed from the hat to replace batteries. There remains a need for improvements to such illuminated hat assemblies.

SUMMARY OF THE DISCLOSURE

This section provides a general summary of the disclosure and is not intended to be interpreted as a comprehensive listing of its full scope or of all of its objects, aspects, features and/or advantages.

According to an object of the present disclosure, an illumination assembly for a hat is provided that is simple and compact in design, and has a discrete, aesthetically pleasing appearance.

According to another object of the present disclosure, an illumination assembly for a hat is provided that has a light housing that is easily removeable from a mounting plate to permit the light housing to be charged separately from a hat, thus permitting a user to wear the hat even while the light housing is charging.

According to another object of the present disclosure, an illumination assembly for a hat is provided that has a light housing that is easily adjustable to different angles to adjust a region of illumination for the user.

According to these and other objects of the disclosure, an illumination assembly for being connected to a hat includes a mounting bracket for being coupled with the hat. A light assembly is removeably connectable to the mounting bracket and includes at least one light emitter for emitting light in front of the hat. The mounting bracket includes at least one rail that slideably receives the light assembly for connecting the light assembly to the mounting bracket.

According to the above and other objects of the disclosure, an illuminating hat assembly comprises a hat that has a front region for being positioned along a forehead of a wearer. A mounting bracket is connected to the front region of the hat. A light assembly is removably connectable to the mounting bracket and includes at least one light emitter for emitting light in front of the hat. The mounting bracket includes a pair of rails that extend in spaced and parallel relationship with one another and slideably receive the light assembly for connecting the light assembly to the mounting bracket.

DRAWINGS

The drawings described herein are for illustrative purposes only of selected embodiments and not all possible implementations thereof such that the drawings are not intended to limit the scope of the present disclosure.

DETAILED DESCRIPTION OF THE EXAMPLE EMBODIMENTS

Example embodiments of an illuminated hat assembly 10, 100 embodying the teachings of the present disclosure will now be described more fully with reference to the accompanying drawings. However, the example embodiments are only provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that the example embodiments may be embodied in many different forms that may be combined in various ways, and that neither should be construed to limit the scope of the disclosure. In some example embodiments, well-known processes, well-known device structures, and well-known technologies are not described in detail.

Figure 1:
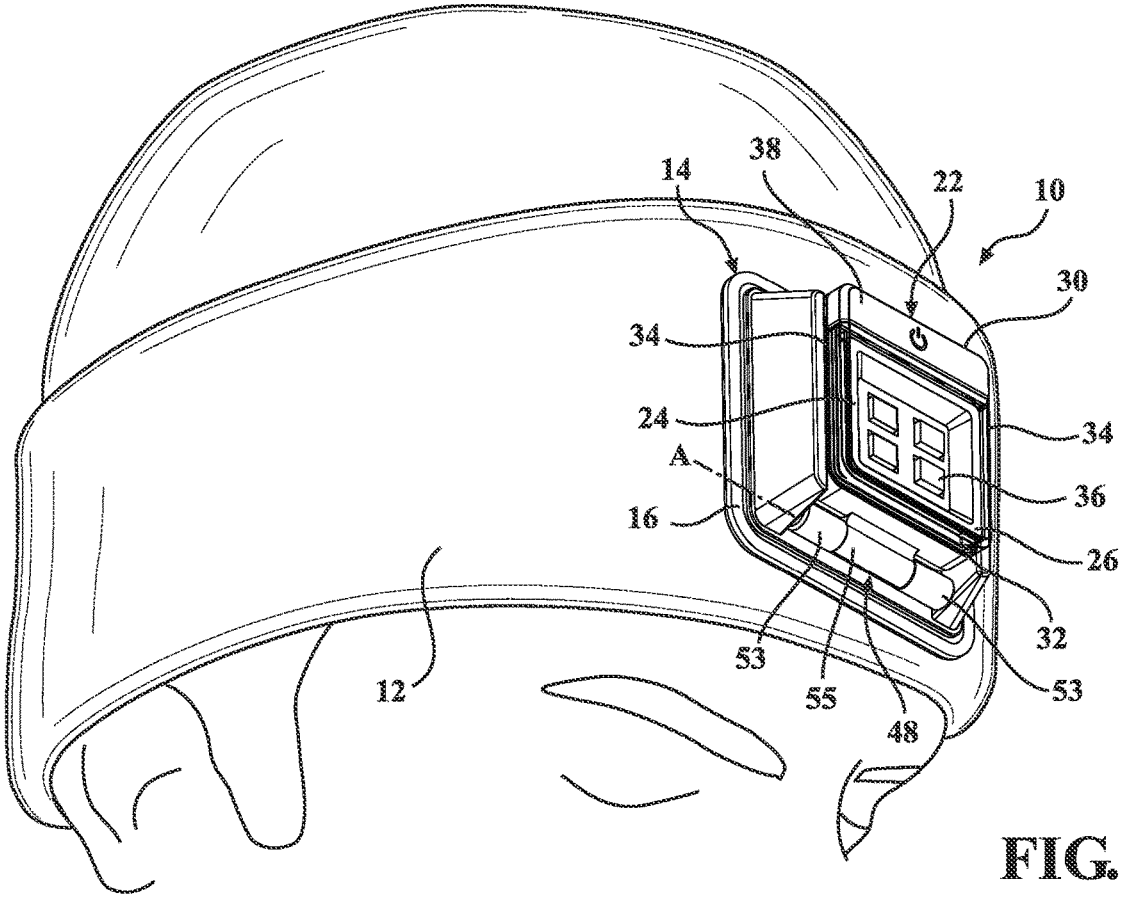
FIG. 1 is a perspective view of a first example embodiment of an illuminated hat assembly, illustrating a light assembly of the illuminated hat assembly connected to a mounting bracket, with the light assembly in an unpivoted position.

More particularly, referring to the figures, wherein like numerals indicate corresponding parts throughout the several views, embodiments of an illuminated hat assembly 10, 100 are shown. As shown in FIG. 1, the illuminated hat assembly 10, 100 includes a hat 12. The example embodiment illustrates a beanie style hat 12, but the teachings herein may be applied to other styles of hats/headgear including, but not limited to, baseball caps, helmets and headbands. It should be appreciated that the term "hat" as used herein may include various types of headgear.

Figure 2:
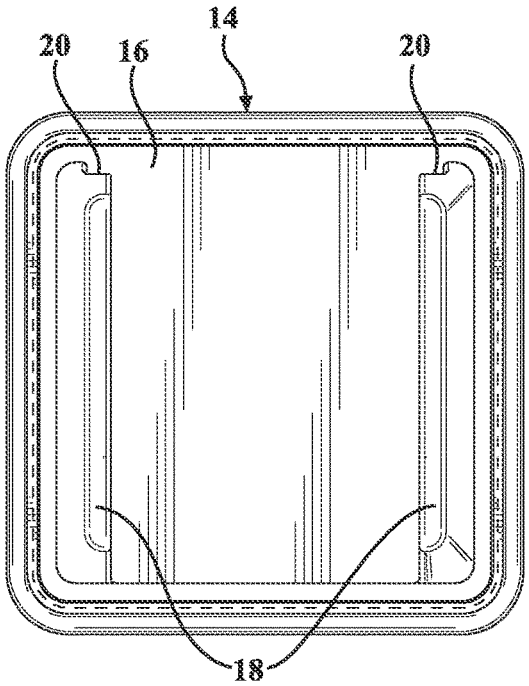
FIG. 2 is a front view of the mounting bracket of the first embodiment of the illuminated hat assembly.

FIGS. 1-7B show a first example embodiment of the illuminated hat assembly 10 the illuminated hat assembly 12. As best shown in FIGS. 1-2 and 6-7, the illuminated hat assembly includes a mounting bracket 14 for being secured to a front of the hat 12. The mounting bracket 12 includes a generally square-shaped and planar base 16. The base 16 could have other shapes. A perimeter of the base 16 is stitched to the hat 12 to secure the mounting bracket 14 to the hat 12. Other fastening mechanisms could be used to connect the base 16 to the hat 12 including, but not limited to, an adhesive or bolts. As best shown in FIG. 2, the mounting bracket 12 further includes a pair of spaced and parallel rails 18 that extend in a vertical direction, each along an edge of the base 16. Each of the rails 18 defines a vertically-extending groove 20.

As best shown in FIGS. 1 and 3-7B, the illuminated hat assembly 10 further includes a light assembly 22 that is removably connectable to the mounting bracket 14 for illuminating a region in front of a user. The light assembly 22 includes a generally square-shaped light housing 24 that has a front face 26, a back face 28, a top 30, a bottom 32 and pair of sides 34. One or more light emitters 36 are located on a lower region of the front face 28. According to the first example embodiment, the light emitters 36 are comprised of four light emitting diodes (LEDs) 36, however, other styles of light emitters could be used, e.g., incandescent bulbs, and any number of light emitters could be used without departing from the scope of the subject disclosure. A power button 38 is located above the light emitters 36 on the front face 26 of the light housing 24 for activating, and changing settings of the light emitters 36. More particularly, as will be discussed in further detail below, the power button 38 may be pressed to toggle between different settings of the light emitters 36. A battery 40 (schematically shown in FIG. 3 and shown as element 140 in FIG. 12) is located inside the light housing 24 for powering the light emitters 36. A charging port 42 and associated cover/seal 44 are located along one of the sides 34 of the light housing 24 for being coupled with a power cable 45 to charge the battery 40. Various types of charging ports 42 such as USB type B, micro USB or USBC ports may be utilized without departing from the scope of the subject disclosure. The cover 44 is configured to provide a water tight seal to the charging port 42.

The light assembly 22 further includes a generally square-shaped mounting plate 46 that is pivotally connected to a region of the bottom 32 of the light housing 24 along a hinge 48. The mounting plate 46 has a front surface 49 and a rear surface 51 opposite the front surface 49, a top edge 50, a bottom edge 39, and a pair of parallel side edges 52 that extend between the bottom and top edges 39, 50. As best illustrated in FIGS. 1 and 6-7B when the light assembly 22 is connected to the mounting bracket 14, the side edges 52 are snuggly received by the grooves 20 of the rails 18 to hold the light assembly 22 in position, and the rear surface 51 of the mounting plate 46 lies flush against the planar base 16 of the mounting bracket 14.

Figure 9:
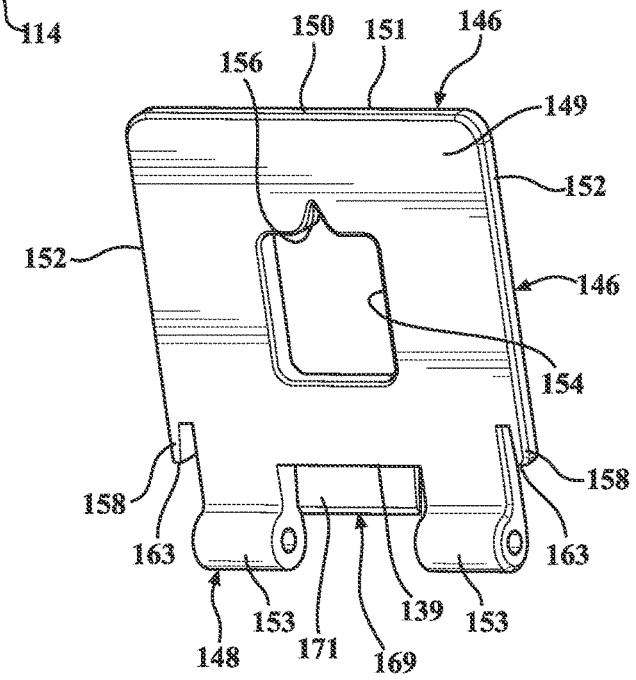
FIG. 9 is a front perspective view of a mounting plate of the second embodiment of the illuminated hat assembly.
Figure 10:
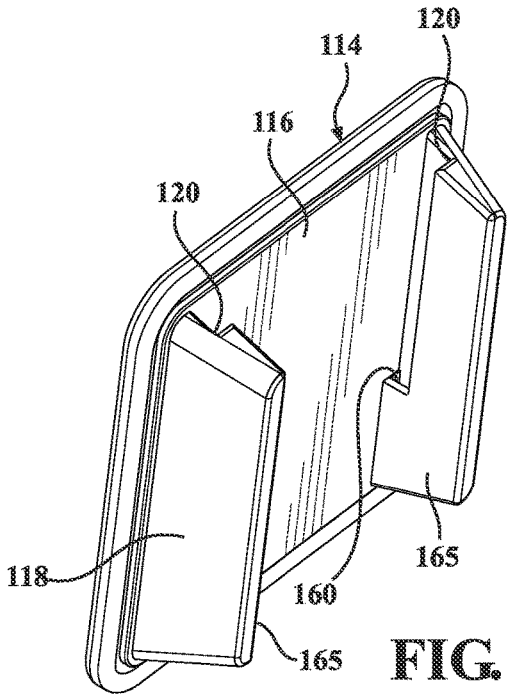
FIG. 10 is a front perspective view of a mounting bracket of the second embodiment of the illuminated hat assembly.
Figure 12:
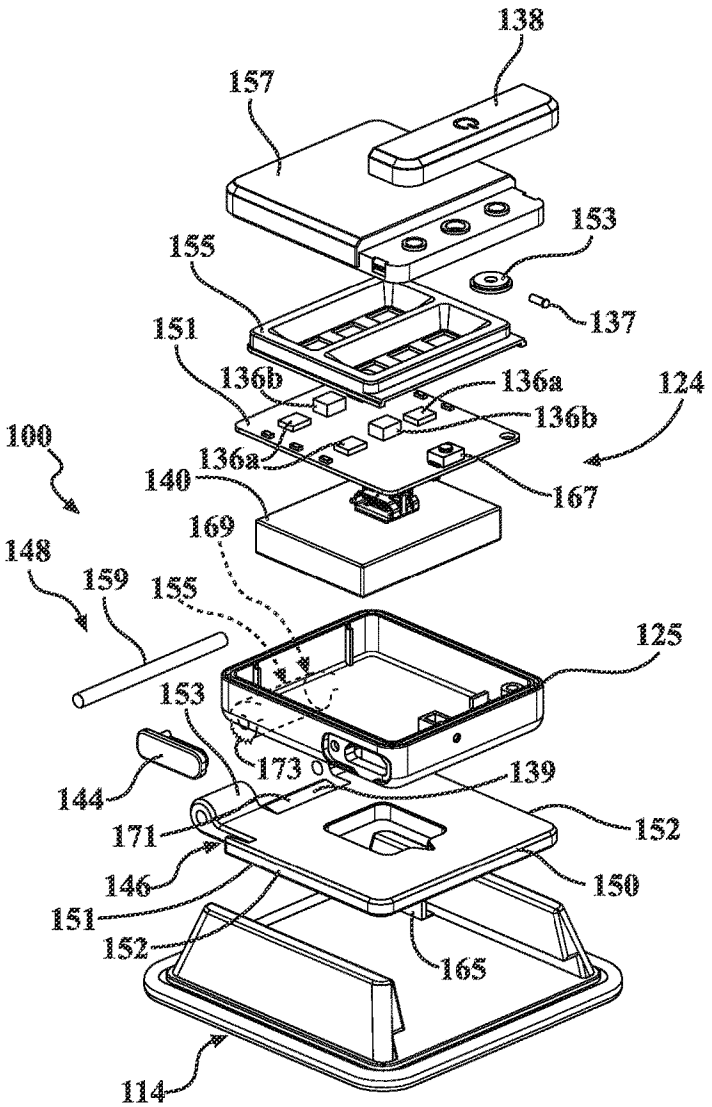
FIG. 12 is a bottom, perspective, exploded view of the second embodiment of the illuminated hat assembly.
Figure 11:
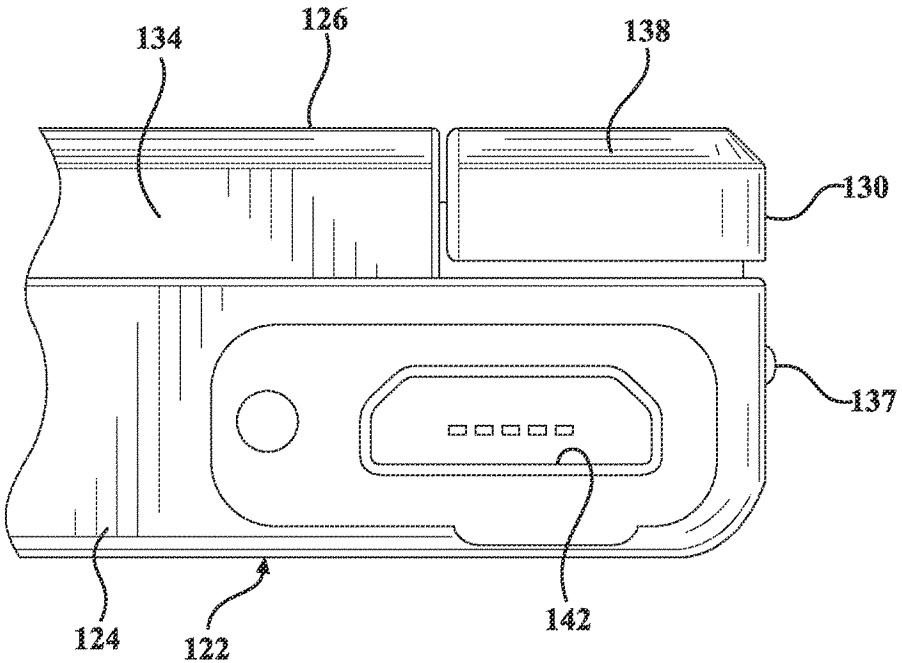
FIG. 11 is a side view of a light assembly of the second embodiment of the illuminated hat assembly, illustrating an alternate charging port.

While coupled with the mounting bracket 14, the light housing 24 is pivotable relative to the mounting plate 46 along the hinge 48 about a hinge axis A for adjusting an angle at which light is projected from the light emitters 36. More particularly, the light housing 24 is pivotable about the hinge axis A at all angles between an un-pivoted position (shown in FIG. 1) and various pivoted positions (shown in FIGS. 3-7B). As shown, the hinge 48 may include a pair of first receivers 53 that are connected to the bottom edge 39 of the mounting plate 46, and a second receiver 55 that is connected to the bottom 32 of the light housing 24. The first and second receivers 53, 55 may each define a bore 57 along the hinge axis A, and a pin 59 may extend through the bores 57 to provide the pivoting movement of the light housing 24 relative to the mounting plate 46. The hinge 48 may also include a ratcheting mechanism 169 for locking the light housing 24 in specific positions. As shown in FIGS. 9 and 12, the ratcheting mechanism 169 may be comprised of a flexible tab 171 that extends from the bottom edge 139 of the mounting plate 46, 146 which engages a series of grooves 173 that extend linearly/axially along the second receiver 55, 155 of the hinge 48, 148. Engagement of the flexible tab 171 into the grooves 173 resists, but not inhibit movement between the different rotational positions.

Figure 4:
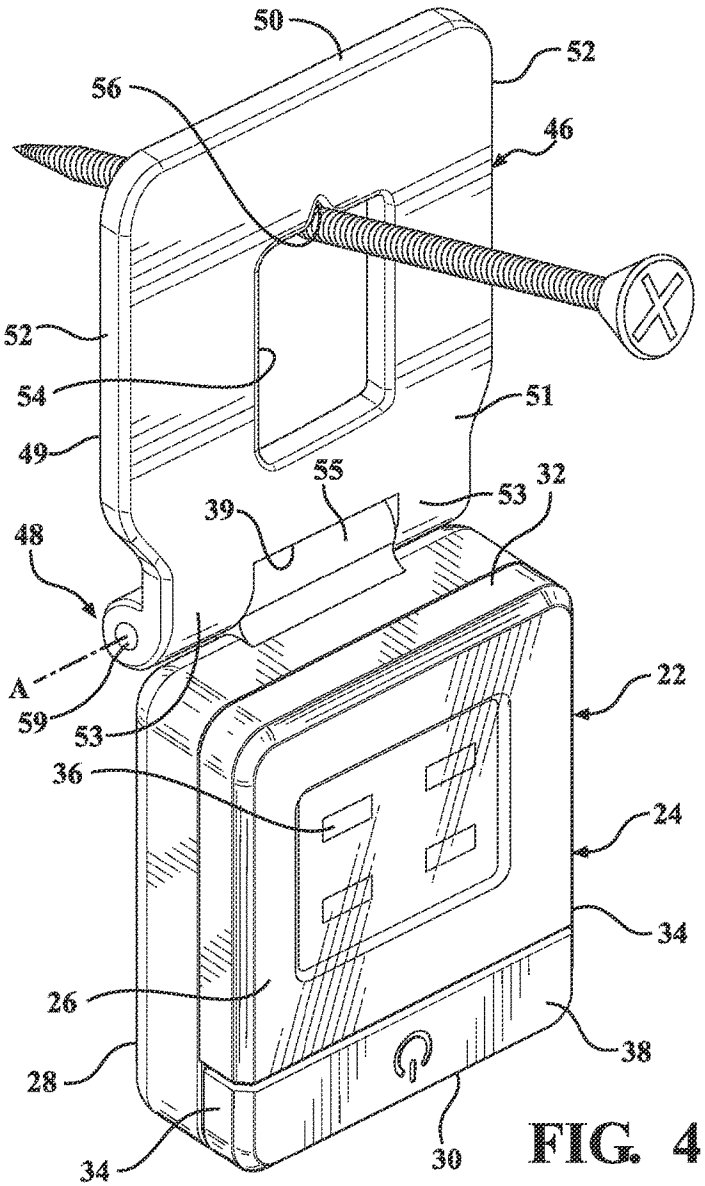
FIG. 4 is a front perspective view of the light assembly of the first embodiment of the illuminated hat assembly, illustrating hanging the light assembly from a nail while disconnected from the mounting bracket and while the light assembly is pivoted 180 degrees.
Figure 3:
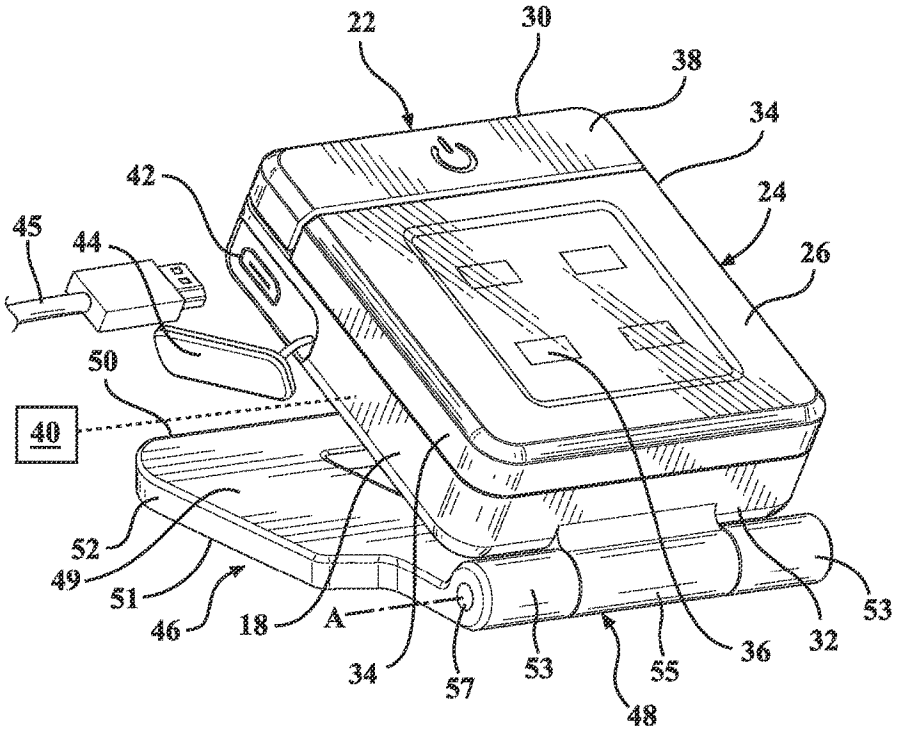
FIG. 3 is a front perspective view of a light assembly of the first embodiment of the illuminated hat assembly in a partially pivoted position.
Figure 5:
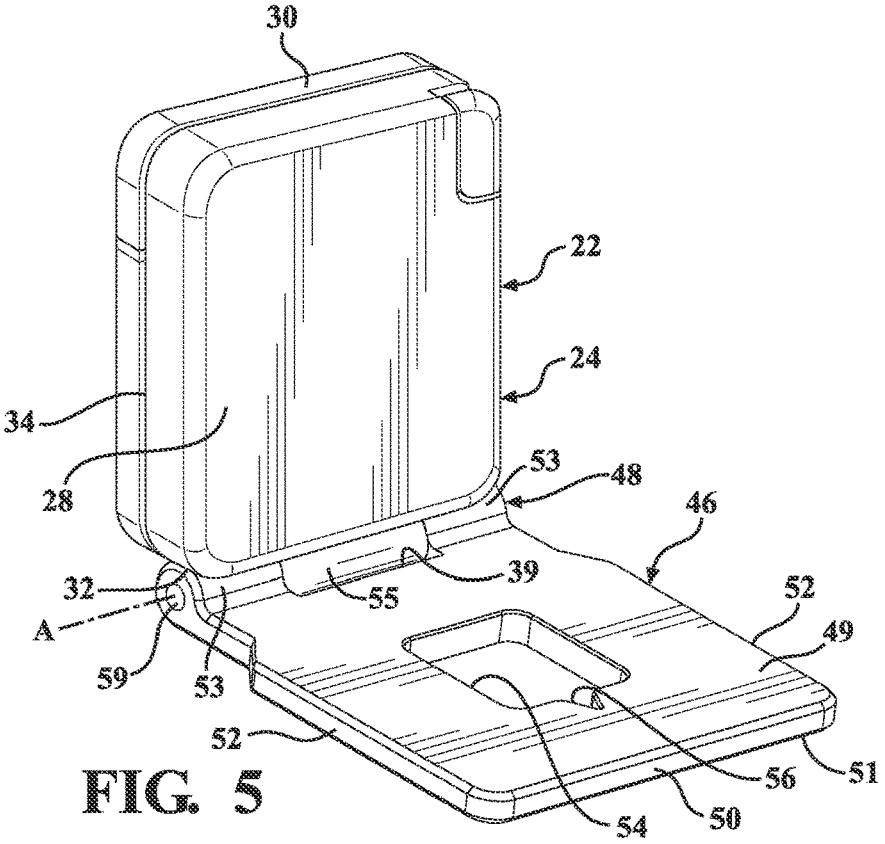
FIG. 5 is a rear perspective view of the light assembly of the first embodiment of the illuminated hat assembly in a partially pivoted position.
Figure 6:
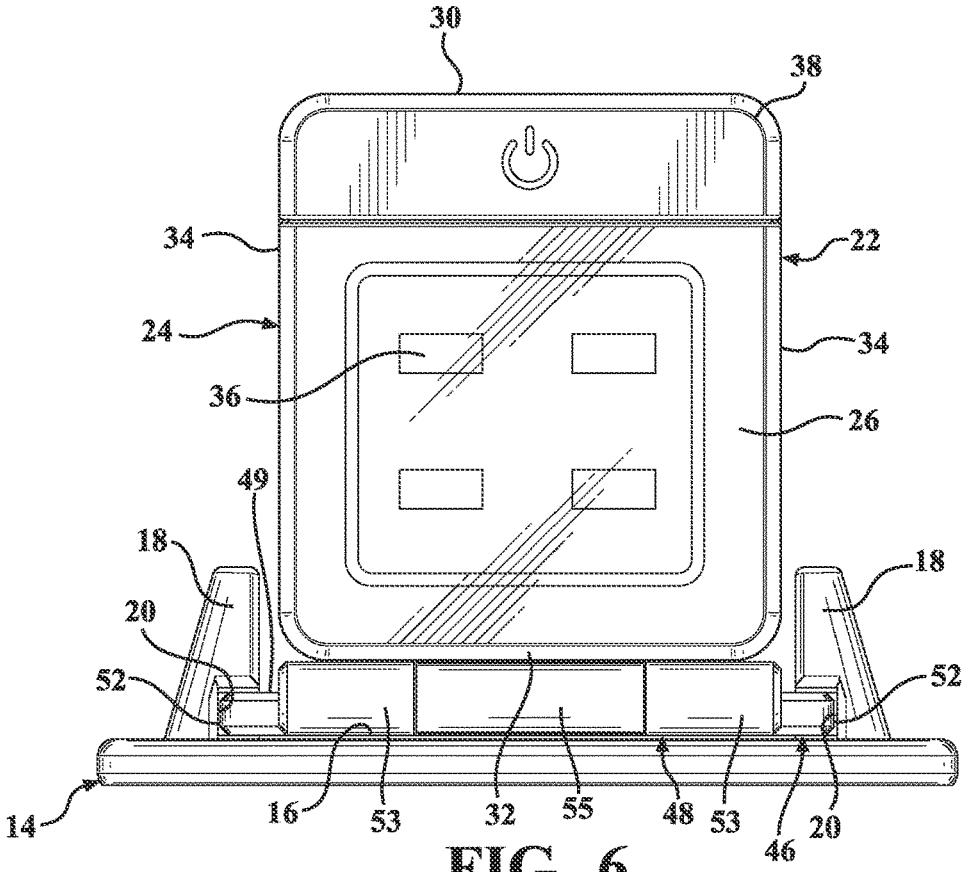
FIG. 6 is front view of the first embodiment of the illuminated hat assembly, illustrating the light assembly in a partially pivoted position while connected to the mounting bracket.
Figure 7A:
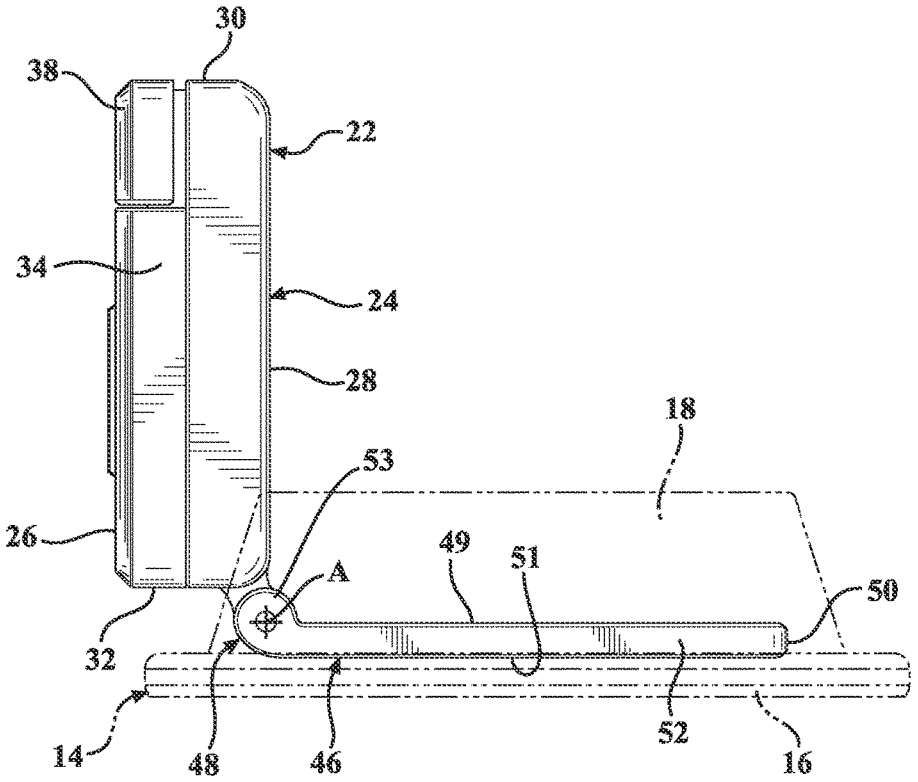
FIG. 7A is a side view of the first embodiment of the illuminated hat assembly, illustrating the light assembly in a partially pivoted position while connected to the mounting bracket.
Figure 7B:
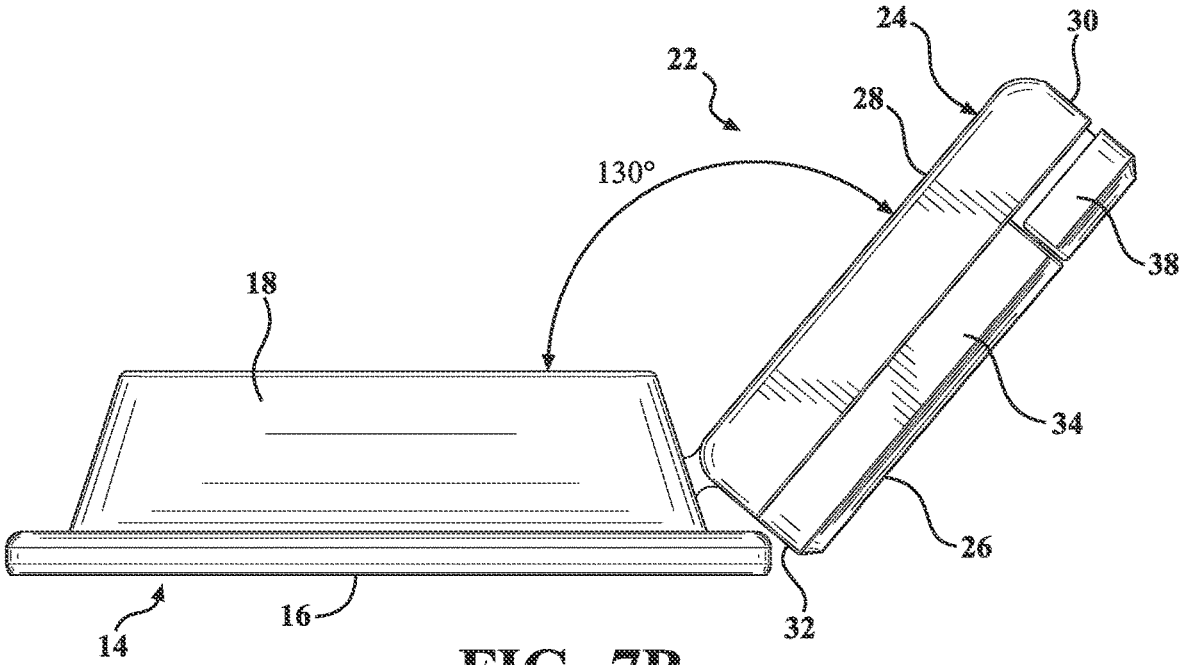
FIG. 7B is a side view of the first embodiment of the illuminated hat assembly, illustrating the light assembly pivoted 130 degrees.
Figure 8:
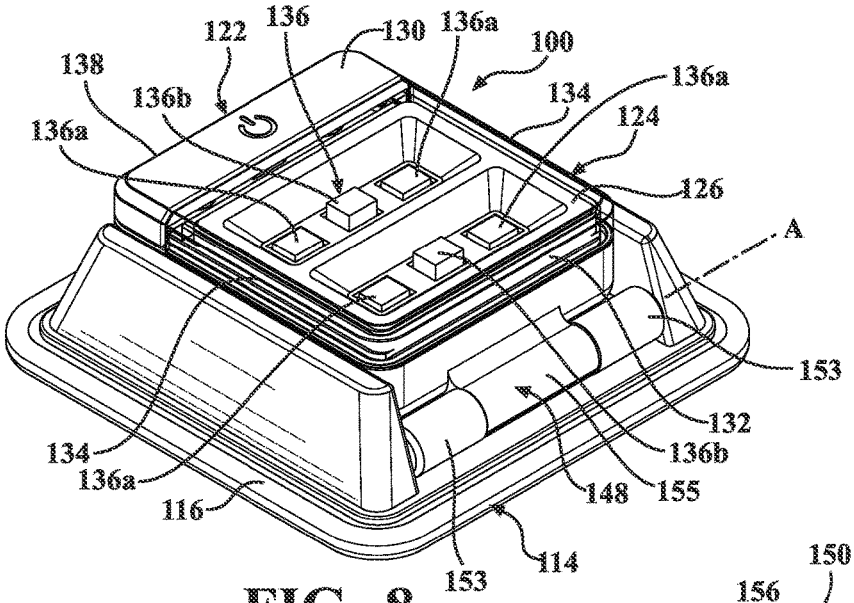
FIG. 8 is a perspective view of a second embodiment of the illuminated hat assembly illustrating the light assembly in an un-pivoted position.

As best shown in FIG. 4, the mounting plate 46 defines a generally square-shaped opening 54 which includes a V-shaped notch 56 at an upper border thereof for allowing the mounting plate 46 to be hung from a screw, hook or other mounting device after being removed from the mounting bracket 14. Of note, this provides a position for charging the device 10, 100 without losing track of its location.

FIGS. 8-12 illustrate a second embodiment of the illuminated hat assembly 100. The second embodiment is constructed and operates in a similar manner as the previously described first embodiment but includes some differences. More particularly, rather than including four light emitters 36 like the first embodiment, the second embodiments includes six light emitters/LEDs 136 as well as a light pipe 137 that extends through the top 130 of the light housing 124. The light emitters 136 and light pipe 137 are configured to emit light at various colors. As previously noted, it should be appreciated that any number of light emitters 136 may be employed. According to this embodiment, outside light emitters 136*a* may emit a white colored light, while central light emitters 136*b* may emit a red colored light, but other colors and configurations may be used. The light pipe 137 may be configured to blink in a red color when the battery 140 is charging, it may emit a constant red light when the battery 140 is at a low power state, and it may emit a constant green light when the battery 140 is fully charged. Furthermore, the central light emitters 136*b* may be configured to emit a flashing red light in an alert mode, and may also be configured to blink a red light two or more times when the battery 40 is at a low power state. Additionally, while in use, the light emitters 36 may be configured to shine in high intensity or low intensity modes, and they may arranged to dim in order to provide power savings. As with the previous embodiment, it should be appreciated that the power button 138 may be pressed to toggle between modes.

Additionally, as best shown in FIG. 9, according to the second embodiment, the mounting plate 146 may further include a pair of legs 158 that each extend along one of the side edges 152 of the mounting plate 146 and extend in spaced and parallel relationship with one another and terminate at a peak 163 that is located adjacent to the hinge 148. Furthermore, each of the grooves 120 of the parallel rails 118 of the mounting bracket 114 terminate at an end component 165, which defines a recess 160. Each of the recesses 160 are configured to receive one of the legs 158 for further inhibiting movement of the mounting plate 146 relative to the mounting bracket 114 via engagement of the peaks 165 of the legs 158 against the end component 165 in the recess 160 of the end component 165, with the light housing 124 centered along the mounting bracket 114.

FIG. 12 is an exploded view of the second embodiment of the illuminated hat assembly 110 illustrating an arrangement of the mounting bracket 114, the mounting plate 146, a case 125 of the light housing 124, the seal 144, the pin 159 of the hinge 148, the battery 140, a printed circuit board (PCB) 151, a silicone cap 153, a reflector 155 of the light housing 124, a cover 157 of the light housing 124 and the power button 138. Of note, the silicone cap 153 functions as a button for the PCB 151 in that it serves as an interfacing unit between an interface between a switch 167 of the PCB 151 and the power button 138. The silicone cap 153 functions like a spring in that it pushes the power button 138 back to a non-depressed position after being pressed so that it may be pushed again.

Figure 13:
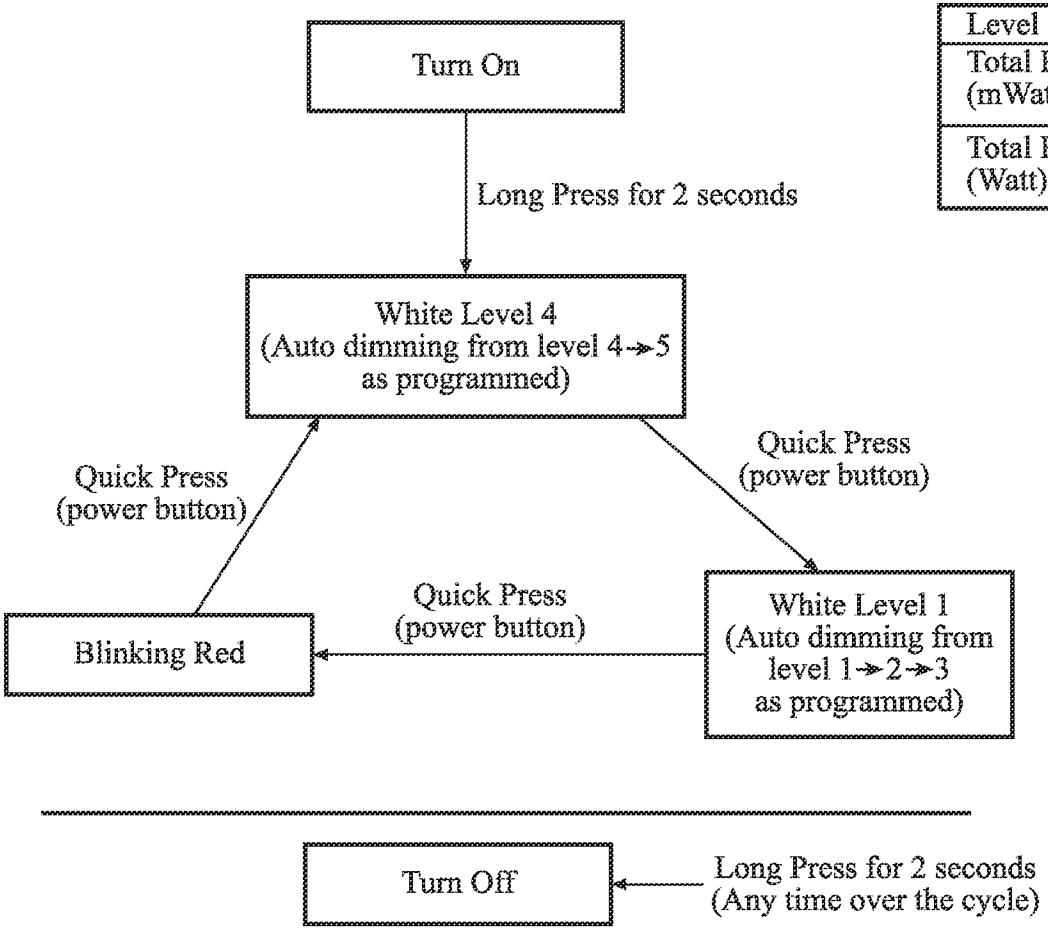
FIG. 13 is a schematic diagram illustrating steps associated with activating different modes of operation of light emitters of the illuminated hat assembly.
Figure 14:
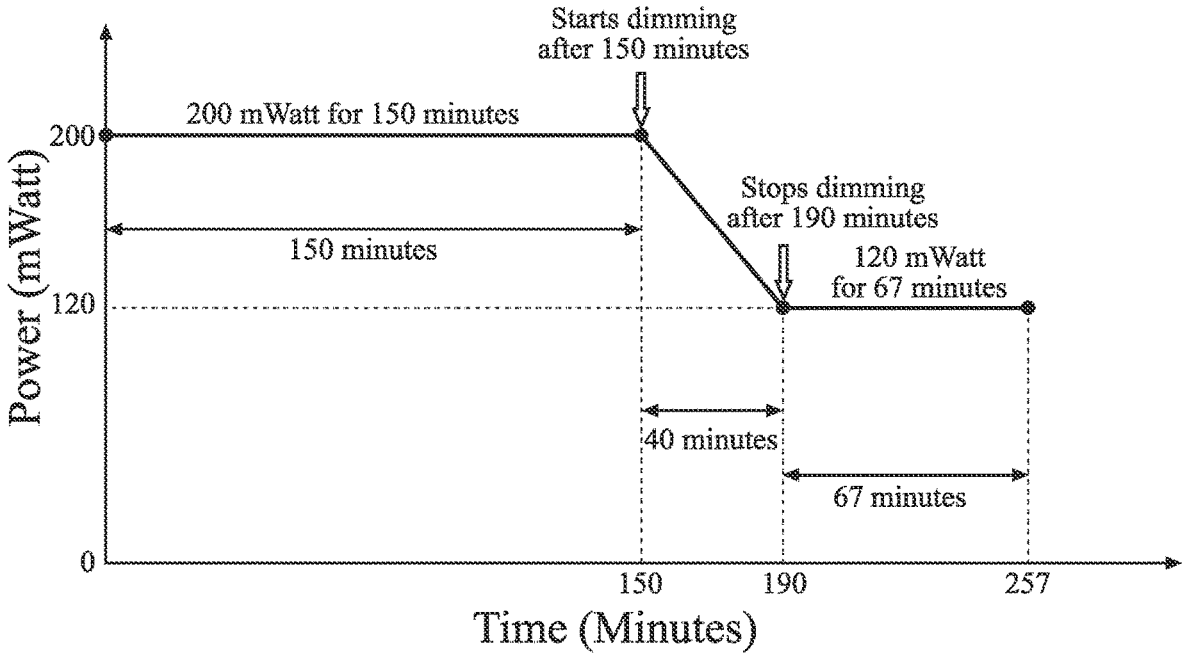
FIGS. 14 and 15 are schematic diagrams illustrating exemplary dimming operations of the light emitters of the illuminated hat assembly.
Figure 15:
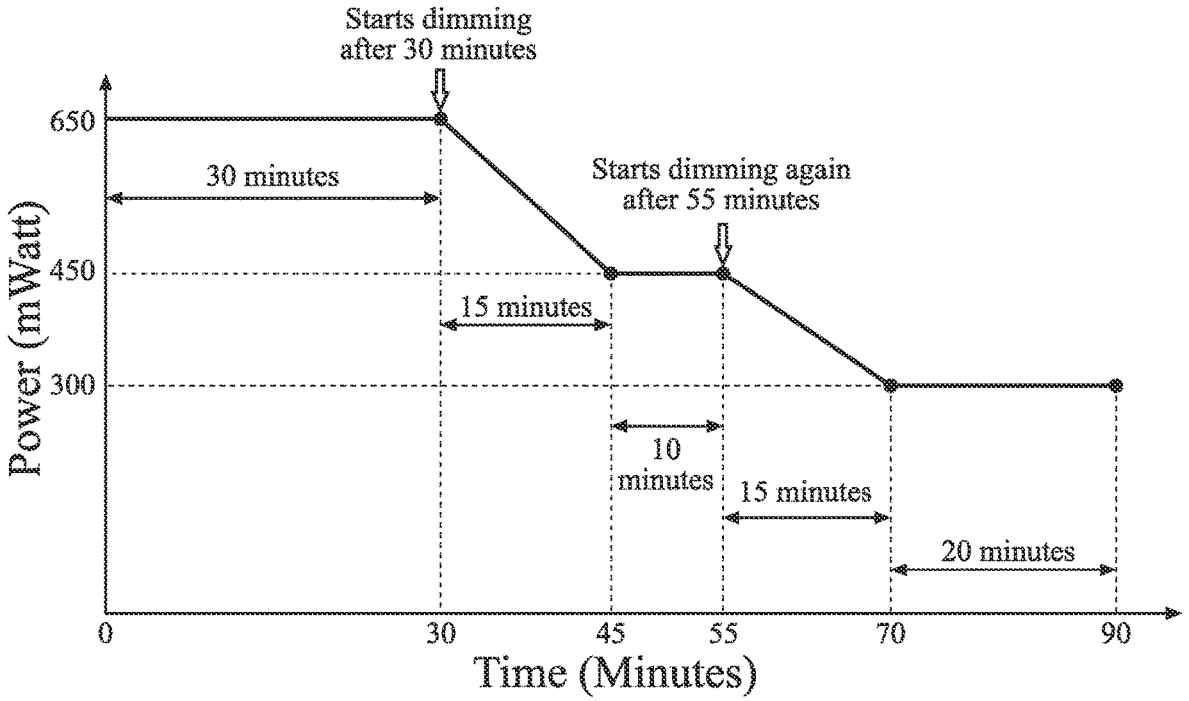

FIG. 13 is a schematic diagram illustrating different options for operating the illuminated hat assembly 10, 110. More particularly, as illustrated, the illuminated hat assembly 10, 110 may be turned on by holding the power button 38, 138 for two seconds. Once activated, the light emitters 36, 136 may be defaulted to shine at a level 4 (medium) intensity. The light emitters 36, 136 may then be switched to different modes, e.g., low, and high intensity or red flashing, in response to quickly pressing the power button 38. The light emitters 36 may be turned off in response to holding the power button 38, 138 for two seconds. FIGS. 14 and 15 illustrate that the light emitters 36, 136 may be configured to automatically dim after predetermined intervals of use in order to preserve battery life. Furthermore, the gradual dimming changes avoid rapid changes in light intensity/lumen and provide an improved consumer experience through subtly lumen changes over time.

In view of the above, the subject illuminated hat assembly 10, 110 provides a simple, compact and reliable arrangement for removably connecting the light assembly 22, 122 to the mounting bracket 14, 14 on the hat 12. Additionally, the illuminated hat assembly 10, 110 allows the light emitters 36, 136 to easily be pivoted to different orientations to provide a desired lighting effect. Moreover, the light assembly 22, 122 can easily be removed for charging while still allowing use of the hat 12. Finally, the illuminated hat assembly 10, 110 is aesthetically pleasing, especially in that the light housing 24, 124 fits discretely in the mounting bracket 14, 114, and the mounting bracket 14, 114.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in that particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or later, or intervening element or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to described various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An illumination assembly for being connected to a hat, comprising:

a mounting bracket for being coupled with the hat;

a light assembly removably connectable to the mounting bracket and including at least one light emitter for emitting light in front of the hat;

the mounting bracket including at least one rail slideably receiving the light assembly for connecting the light assembly to the mounting bracket; and wherein the light assembly includes a mounting plate having a pair of sides edges extending linearly between a top edge and a bottom edge, wherein the mounting plate is slideably received by the at least one rail along at least one of the side edges, and a light housing including the at least one light emitter, and wherein the light housing is pivotally connected to the bottom edge of the mounting plate to allow a user to adjust an angle of light projected by the at least one light emitter.

2. The illumination assembly as set forth in claim 1, wherein the at least one rail of the mounting bracket includes a pair of rails extending in spaced and parallel relationship with one another, and wherein the mounting plate includes a pair of side edges each received by one of the rails of the mounting bracket.

3. The illumination assembly as set forth in claim 2, wherein each of the rails includes a linear groove each receiving one of the side edges of the mounting plate.

4. The illumination assembly as set forth in claim 3, further including a hinge pivotally connecting the light housing to the mounting plate at the bottom edge of the mounting plate, and wherein the light housing is pivotable relative to the mounting plate about an axis defined along the hinge.

5. The illumination assembly as set forth in claim 4, wherein the mounting bracket has a planar base surface between the rails, wherein the mounting plate has a front surface and a rear surface opposite the front surface, and wherein the rear surface of the mounting plate is configured to lie flush against the planar base surface of the mounting bracket when the light assembly is connected to the mounting bracket.

6. The illumination assembly as set forth in claim 5, wherein the light housing has a front face and a back face opposite the front face, wherein the light emitter is located on the front face, and wherein the light housing is pivotable between an un-pivoted position in which the back face of the light housing is substantially parallel with the front surface of the mounting place, and pivoted positions in which the back face is located at various angles relative to the front surface of the mounting plate.

7. The illumination assembly as set forth in claim 1, wherein the mounting plate defines an opening for allowing the light housing to be hung from a hanging device while disconnected from the mounting bracket.

8. The illumination assembly as set forth in claim 1, wherein the light assembly defines a charging port to permit the light assembly to be charged when disconnected from the mounting bracket.

9. An illumination assembly for being connected to a hat, comprising:

a mounting bracket for being coupled with the hat;

a light assembly removably connectable to the mounting bracket and including at least one light emitter for emitting light in front of the hat;

the mounting bracket including at least one rail slideably receiving the light assembly for connecting the light assembly to the mounting bracket;

the light assembly including a mounting plate slideably received by the at least one rail, and a light housing including the at least one light emitter, wherein the light housing is pivotally connected to the mounting plate to allow a user to adjust an angle of light projected by the at least one light emitter;

the at least one rail of the mounting bracket including a pair of rails extending in spaced and parallel relationship with one another;

the mounting plate including a pair of side edges each received by one of the rails of the mounting bracket;

each of the rails including a linear groove each receiving one of the side edges of the mounting plate; and a hinge pivotally connecting the light housing to the mounting plate, wherein the light housing is pivotable relative to the mounting plate about an axis defined along the hinge;

wherein a pair of legs each extend along one of the side edges of the mounting plate, and wherein each of the grooves of the rails terminates at an end component defining a slot, wherein the pair of legs are each configured to be received in one of the slots of the rails, and wherein movement of the light housing relative to the mounting bracket is limited by engagement of the legs against the end component.

10. The illumination assembly as set forth in claim 9, wherein the hinge is located adjacent to the legs of the light housing.

11. An illuminating hat assembly, comprising:

a hat having a front region for being positioned along a forehead of a wearer;

a mounting bracket connected to the front region of the hat;

a light assembly removably connectable to the mounting bracket and including at least one light emitter for emitting light in front of the hat; and the mounting bracket including a pair of rails extending in spaced and parallel relationship with one another and slideably receiving the light assembly for connecting the light assembly to the mounting bracket;

wherein the light assembly further includes a mounting plate slideably received by the at least one rail, and a light housing including the at least one light emitter, and wherein the light housing is pivotally connected to an end of the mounting plate to allow a user to adjust an angle of light projected by the at least one light emitter;

wherein the mounting plate defines an opening for allowing the light housing to be hung from a hanging device while disconnected from the mounting bracket.

12. The illuminating hat assembly as set forth in claim 11, wherein the mounting bracket is stitched to the front region of the hat.

13. The illuminating hat assembly as set forth in claim 11, wherein the mounting plate includes a pair of side edges each received by one of the rails of the mounting bracket.

14. The illuminating hat assembly as set forth in claim 13, wherein each of the rails of the pair of rails includes a linear groove each receiving one of the side edges of the mounting plate.

15. The illuminating hat assembly as set forth in claim 14, further including a hinge pivotally connecting the light housing to the mounting plate at the end of the mounting plate, and wherein the light housing is pivotable relative to the mounting plate about an axis defined along the hinge.

16. The illumination assembly as set forth in claim 15, wherein the mounting bracket has a planar base surface between the rails, wherein the mounting plate has a front surface and a rear surface opposite the front surface, and wherein the rear surface of the mounting plate is configured to lie flush against the planar base surface of the mounting bracket when the light assembly is connected to the mounting bracket.

17. The illuminating hat assembly as set forth in claim 14, wherein a pair of legs each extend along one of the side edges of the mounting plate, and wherein each of the grooves of the rails terminates at an end component defining a slot, wherein the pair of legs are each configured to be received in one of the slots of the rails, and wherein movement of the light housing relative to the mounting bracket is limited by engagement of the legs against the end component.

18. The illuminating hat assembly as set forth in claim 17, wherein the hinge is located adjacent to the legs of the light housing.

* * * * *